US005314006A

United States Patent [19]

Kaastra et al.

[11] Patent Number: 5,314,006

[45] Date of Patent: May 24, 1994

[54] SHEET METAL HEATING PACKAGE FOR REGENERATIVE HEAT EXCHANGERS AS WELL AS A METHOD AND APPARATUS FOR MANUFACTURE OF PROFILED METAL SHEETS FOR SUCH SHEET METAL HEATING PACKAGES

[75] Inventors: Simon Kaastra, V-Dinxperlo, Netherlands; Gerd Köster, Reichshof-Odenspiel, Fed. Rep. of Germany

[73] Assignee: Apparatebau Rothemühle Brandt & Kritler Gesellschaft mit beschränkter Haftüng, Wendenm, Fed. Rep. of Germany

[21] Appl. No.: 912,457

[22] Filed: Jul. 13, 1992

[30] Foreign Application Priority Data

Jul. 11, 1991 [DE] Fed. Rep. of Germany ..... 4122949

[51] Int. Cl.[5] ..... F28D 19/04

[52] U.S. Cl. ..... 165/10; 165/8; 165/133; 29/890.034

[58] Field of Search ..... 165/10, 133, 8

[56] References Cited

U.S. PATENT DOCUMENTS 3,262,490 7/1966 Olson ..... 165/10
4,449,573 5/1984 Pettersson ..... 165/10

FOREIGN PATENT DOCUMENTS 2616816 10/1977 Fed. Rep. of Germany .
1439674 6/1976 United Kingdom ..... 165/10
2183811 6/1987 United Kingdom ..... 165/10

*Primary Examiner*—Albert W. Davis, Jr.
*Attorney, Agent, or Firm*—Anderson Kill Olick & Oshinsky

[57] ABSTRACT

A sheet metal heating package for heat exchangers including a plurality of superimposed sheets having at least a partial profiling for instance embossments leaving free flow channels in between themselves, which sheets carry a coating serving as a surface protection, for instance a layer enamel, the sheet metal heating package having a profiling of the sheets, where at least the border edges of the respectively adjoining directly superposed sheets have a minimum spacing from each other at all points or are aligned so as not to contact each other, the border zones of the sheets and possibly the process technology-wise caused material accumulations arising at the border edges of the coating are in this way protected against chipping or spalling.

8 Claims, 2 Drawing Sheets

Fig.6
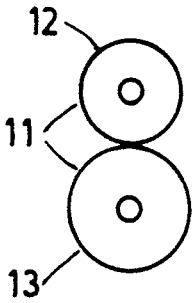
Fig.4A
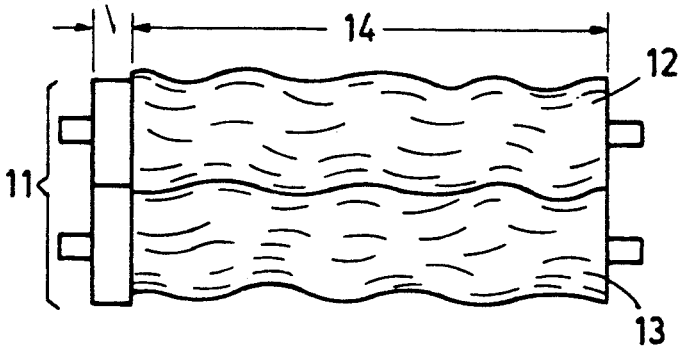
Fig.5
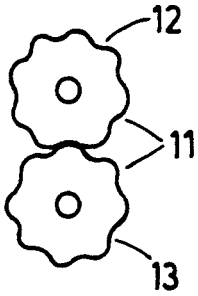
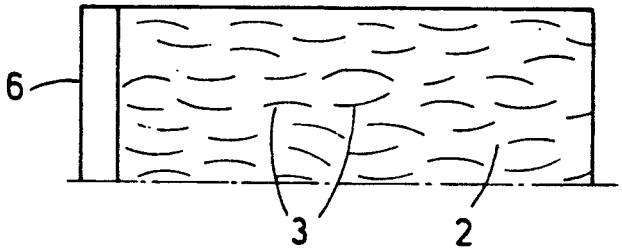
Fig.4B
Fig.7
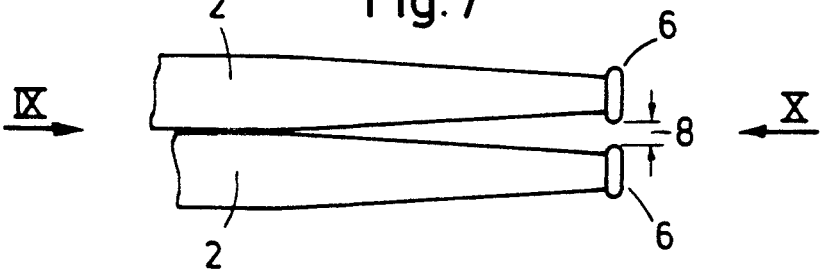
Fig.8
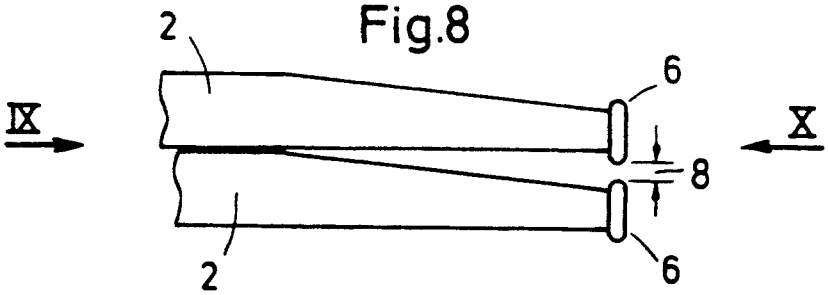
Fig.9
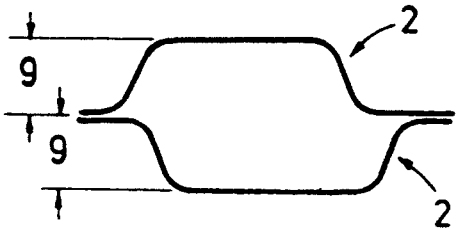
Fig.10
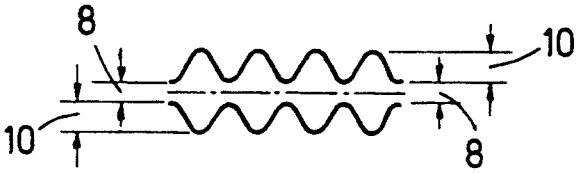

SHEET METAL HEATING PACKAGE FOR REGENERATIVE HEAT EXCHANGERS AS WELL AS A METHOD AND APPARATUS FOR MANUFACTURE OF PROFILED METAL SHEETS FOR SUCH SHEET METAL HEATING PACKAGES

BACKGROUND OF THE INVENTION

The invention deals with a sheet metal heating package for regenerative heat exchangers, comprising a plurality of superimposed metal sheets leaving flow channels free in between the sheets and provided at least partially with profiled, for example, embossed sheets which carry a coating, for instance an enamel layer, for surface protection.

The invention also deals with a method and an apparatus for the manufacture of such profiled areas provided with a surface coating for sheet metal heating packages.

Sheet metal heating packages of this type for regenerative heat exchangers are already known from DE-AS 26 16 816. It is however also already known to provide enamel surface protection for the metal sheets which leave flow channels free in between themselves and are provided at least in part with profiles, for instance embossed ones, for the building of such sheet metal heating packages.

Sheet metal heating packages, made of sheet metal with a coating, especially enamel, for surface protection, are always used in regenerative heat exchangers if these are intended to attain a sufficiently high useful life in spite of corrosion exposure and/or if some cleanliness of the heating surfaces is to be assured in order to avoid fire hazard.

It occurs frequently when packaging profiled metal sheets into sheet metal heating packages, that the edge regions or border edges of adjoining sheets come in contact with each other before the remaining area regions. This entails the disadvantage that the surface coating chips off or spalls in the edge region, so that the surface protection is lost there and thus an increased danger of corrosion is set up.

SUMMARY OF THE INVENTION

Accordingly, it is an object of the present invention to remove the disadvantages arising in the course of packaging the known profiled sheet metal into a sheet metal heating package. Therefore, this task requires a solution to eliminate damage of the surface protection coating at the border edges of the profiled sheet metal, and thus, to also avoid the partial danger of corrosion of the profiled sheet in the sheet metal heating package.

Pursuant to this object, and others which will become apparent hereafter, one aspect of the present invention resides in profiling the metal sheets so that at least the border edges of the respectively adjoining directly superimposed metal sheets have a minimum spacing from each other at all points or are aligned so as to be free of contact with each other.

Since a mutual contact of directly superimposed metal sheets along their border edges is eliminated, chipping of the edge protective layer, which is highly undesirable, resulting from conditions of stress, cannot occur. This applies also to such profiled metal sheets where an accumulation of coating material has occurred during application of the surface protection coating and in particular of an enamel layer along the border edges, which shapes up to an indeed slight, however approximately bead-like thickening in appearance compared to the area coating.

Furthermore, the invention provides that the minimum spacing between the border edges of the sheet is larger than the normal coating thickness and also larger than the coating thickness dimension at the facing each other side areas of the border edges.

Contact stresses between the bead-like thickened border edge coatings are thus avoided in any case upon assembly of the sheet metal heating package without any additional effort.

One practical embodiment for solving the defined objective includes reducing the height of the profile of the metal sheets at least in the region of the border edges, as compared to the remaining areas of the sheets. This can be achieved by one of two adjoining directly superimposed sheets respectively having a profiled border edge, while the border edge of the other metal sheet runs in a straight line.

However, it is also possible to provide respectively one of two parallel border edges of a sheet with a profiling, while the other one runs in a straight line and herein sheets located respectively adjoining directly one upon another are turned in their plane through 180° relative to each other.

The border edges of the sheet having the minimum spacing or distance from each other are expediently provided so that within the sheet metal heating package, they respectively face the flow inlet- and outlet-edge of the heat exchanger. Thus, they extend with their bead-like thickened surface coating laterally to the impingement direction of the aggressive media passing through the heat exchanger.

The inventive method for manufacturing of profiled metal sheets for sheet metal heating packages by rolling, pressing or stamping, is essentially distinguished in that different deformation forces are exerted on the zones of the sheets running along the border edges than upon the central region of the sheets. Herein, these other deformation forces can be exerted at the same point in time at which also the profiling proper of the sheet is performed. The border edge processing of the sheets occurs chronologically at the same time as the fabrication of the profiling proper.

It is to be sure also provided in the invention, that the zones of the sheets extending along the border edges can be rerolled, repressed or restamped in order to flattening the profiles.

The inventive apparatus for implementing the above described method consists of two profiling tool halves which can be brought to bear upon the planar sheet from two opposite sides. This apparatus is characterized in that the regions of the profiling tool halves assigned to the border edges of the sheet enclose between themselves converging or step-like offset shaping profiles.

Pairs of rollers or pressing or embossing plates or dies, with end segments or area zones which are at least slightly inclined or step-like offset against their principal working plane, can be utilized as profiling tool halves.

In equipping the apparatus with pairs of profiled rollers, the rolls are provided at their ends with smooth roll segments that are stepped or scaled down in an annularly-shaped manner.

A device for performing the method, with which the zones of the sheets extending along the border edges can be rerolled, repressed or restamped to obtain a profile flattening, is characterized by two reshaping tool halves which can be brought to bear from opposite sides on the already profiled sheet for reshaping narrow edge regions adjacent to the border edges of the sheet. Here, also pairs of rolling or pressing or stamping plates with slightly inclined and profiled or stepped and smooth shaping surfaces compared to the upstream profiling tool halves can be used as reshaping tool halves. Finally, in case of utilization of a reshaping pair of rolls, the rolls are finally configured as smooth rolls.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIGS. 4A, B, 5 and 6 schematically illustrate in a simplified manner an embodiment of an apparatus for manufacturing profiled metal sheets for the construction of sheet metal heating packages; and FIGS. 7 to 10 show additional possible shaping forms for profiling of the sheet adjoining with their border edges.

DETAILED DESCRIPTION OF THE PREFERRED EMBODIMENTS

Figure 1:
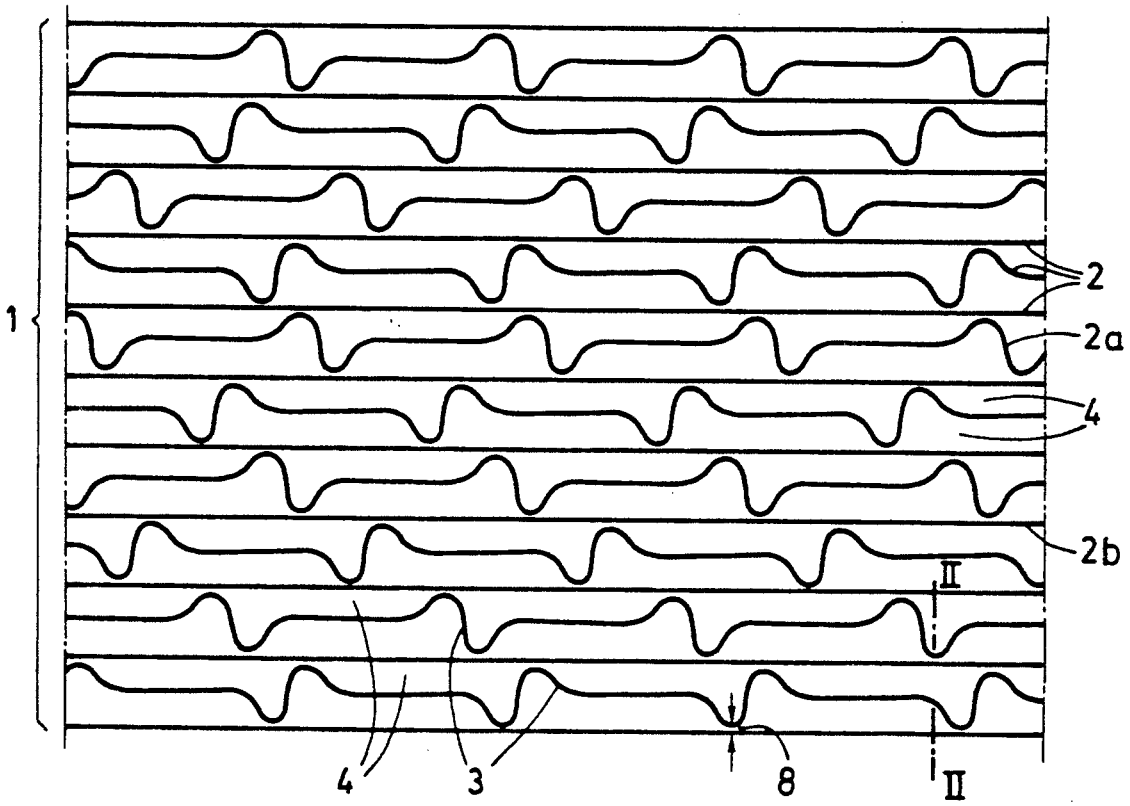
FIG. 1 is front view of a partial region of a sheet metal heating package for regenerative heat exchangers.

In FIG. 1, a cutout area from a sheet metal heating package 1 is illustrated, which is formed of a plurality of directly superimposed or stacked metal sheets 2, which, by way of example, are arranged in two groups 2*a* and 2*b* alternately above one another.

At least the sheet 2 of the group 2*a* , preferably however the sheet 2 of both groups 2*a* and 2*b* are provided with profiling 3, for instance in the form of embossments, as can be clearly recognized in the sheets 2 of the group 2*a* in FIG. 1

The individual profiling 3 has the shape of irregular undulations in the sheet 2 of the group 2*a*, which undulations however extend not only in the lateral direction of the sheet, as seen in FIG. 1, but also in the longitudinal direction of the sheet.

The profiling or embossments extending in the shape of irregular undulations are naturally stamped in multiple repetitions into the individual sheets 2, as this is also seen in FIG. 1 of the drawing.

The profilings 3, executed for instance in the shape of embossments, leave a plurality of flow channels 4 free respectively between two adjoining superimposed or stacked sheets 2 within the sheet metal heating package 1. Through which channels alternately the different heat exchange media flow in the principal flow direction of the heat exchanger equipped with the sheet metal heating package 1. Herein, it is advantageous if the flow channels 4 of the sheet metal heating package bounded in between the sheets 2, extend not only essentially in the main flow direction of the heat exchange media, but also deviate considerably from the straight principal flow direction along the sheets.

This layout of the sheet metal heating package 1 in connection with the profiling 3 formed by irregularly extending undulations, for instance by embossments, in its lateral direction as well as its longitudinal direction entails a marked increase of the heat transfer quantity with simultaneous lowering of pressure losses.

Figure 3:
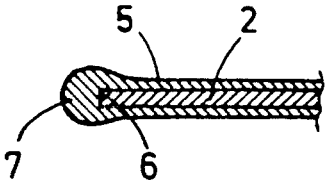
FIG. 3 shows the border edge region of a metal sheet from a sheet metal heating package with surface protection coating and bead-like thickening at the border edge of the sheet at a magnified scale.

All the sheets 2 assigned to the groups 2*a* and 2*b* in the sheet metal heating package, are equipped with a coating 5, especially an enamel coating, that serves for surface protection of the sheets, as FIG. 3 of the drawing shows.

When applying this coating 5 material, an accumulation 7 in the form of a bead-like thickening can, because of production reasons, form along the border edges 6 of the sheets 2. These accumulations 7 provide the advantage of an increased protective effect against aggressive components in the media at the border edges 6. This protective effect can, of course, only be provided in a durable or lasting manner if one counters the chipping of the coating 5 and especially of the material accumulation 7 in the region of the border edges 6 of the sheet 2.

Figure 2A:
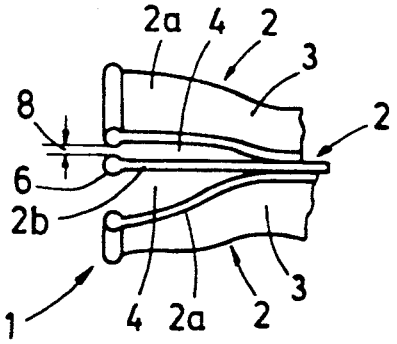
FIGS. 2A, B show corner regions of a sheet metal heating package facing away from each other, sectioned along the line II—II in FIG. 1.
Figure 2B:
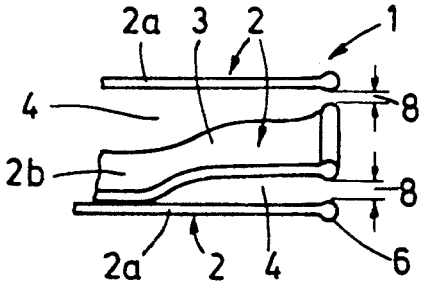

In order to counter the possibility of a chipping or spalling of the coating 5 and possibly of the material accumulation 7 in the region of the edges 6 of the sheets 2, the profiling 3 of the sheets, which for instance 15 are produced as embossments, is arranged so that at least the border edges 6 of the respectively adjoining directly superimposed or stacked sheets 2 of both groups have a minimum spacing 8 from each other at all points, or are aligned contact-free with respect to each other, as can be seen from FIG. 1 and FIG. 2.

The minimum spacing 8 between the border edges 6 of the sheet 2 of neighboring groups 2*a* and 2*b* should be in any case dimensioned to be larger than the thickness of the coating 5 in the region of the bead-like thickening formed by the material accumulation 7.

In the simplest case, the conditions for observing the minimum spacing 8 between the border edges 6 of directly superimposed sheets 2 can be achieved by not providing a profiling to respectively at least one of the sheets across an edge strip of appropriate width, or by keeping this edge completely planar, as is shown in FIGS. 1 and 2 on the sheets 2 of group 2*b*.

The construction of a sheet metal heating package 1 discernable from FIGS. 1 and 2 can again be achieved in that only one of two adjoining directly superimposed sheets 2 has respectively a profiled border edge 6, as the sheets of group 2*a* in FIG. 1 show, while the border edge 6 of the other sheet 2 extends in a straight line, as can be recognized from the group 2*b*.

It is possible for forming a sheet metal heating package 1 structured in such a way to utilize sheets 2 of which only one of two parallel border edges 6 is respectively provided with a profiling, while the other extends in a straight line, and that the respectively adjoining directly superimposed sheets 2 are arranged to be turned in their plane through 180° relative to each other.

Sheets 2, which at least along one of their border sections have no or a lesser profiling than on their entire remaining surface, can be manufactured by rolling, pressing or stamping, in other words by different mechanical methods. Herein, different deformation forces are exerted upon the zones of the sheets 2 extending along the border edges 6 than upon their central region where the profiling 3 for a definition of the flow channels 4 is located.

The shaping in the region of the border edges 6 and the manufacture of the profiling 3 can occur simultaneously or in one working pass by appropriate shaping of the profiling tools, which can be configured in the form of pairs of rolls or pairs of pressing- or stamping plates or dies.

It is, however, also possible to rework the zones of the sheets 2 extending along the border edges 6 in a subsequent work step, after the already accomplished profiling, so as to reroll, repress or restamp the edges in order to flatten the profile.

A pair of rolls 11 is seen in FIGS. 4 to 6 as the device for fabricating sheets 2 for the construction of sheet metal heating packages 1, whose rolls 12 and 13 comprise matching profiling in their barrel circumference.

The two rolls 12 and 13 of the pair of rolls 11 have across the larger portion 14 of their barrel length a profiling 3 of more or less irregular initial shape-producing embossments, as is evident from FIG. 5.

The two rolls 12 and 13 of the pair of rolls 11 comprise however over the smaller portions 15 of their barrel length shaping surfaces that are circular across their circumference and scaled or stepped down with respect to one another, as shown in FIG. 6.

By means of a pair of rolls 11 laid out in such a way, sheets 2 can be produced in one working pass which are shaped to be completely planar only along a border edge 6 parallel to the throughput direction, while their remaining area region is provided with the more or less irregular profiling 3 in the form of embossments.

It is naturally also possible to pass the sheets 2 to begin with across their entire width through a pair of rolls 11, which have a barrel profiling of the individual rolls 12 and 13 indicated in FIG. 5. Subsequently, the profiled sheet 2 can then be passed with is border edge 6 through an additional but more narrow pair of rolls, whose rolls 12 and 13 have a smooth circular barrel-shape, in order to thereby reroll the region of the border edge 6 so as to produce a profile flattening.

While sheets 2 can be produced in a continuous work process or by processing of strip material with the use of a pair of rolls shown in FIGS. 4 to 6, these prefabricated sheet metal blanks can be fabricated in an equivalent way but discontinuously when using pressing or stamping die pairs in presses.

Possibilities are additionally indicated in FIGS. 7 to 10, by means of which the task on which the invention is based can be solved in that the profiling height of the sheet 2 is reduced in the region of the border edges 6 compared to the remaining area region.

It can be seen in FIG. 7, that it is possible to terminate the profiling 3 of the sheets 2 so that it converges on both sides towards their border edges 6, in order to obtain the desired minimum spacing 8 in the region of the border edges. FIG. 8 clarifies on the other hand that the same results can also be achieved, if the profiling 3 of the sheets 2 terminates on one side so as to be converging towards the border edge 6.

While in FIG. 9 (compare arrow IX in FIGS. 7 and 8) the maximum profile height 9 of the sheets 2 is shown in sideways spacing from their border edges 6, there results from FIG. 10 (compare arrow X in FIGS. 7 and 8) its reduced profile height 10 in the region of the border edge 6, by means of which the minimum spacing 8 between the border edges 6 of two adjoining superimposed sheets 2 is again defined clearly.

Devices can be used for fabrication of the sheets 2 designed according to the FIGS. 7 to 10, which consist of two profiled tool halves which can be brought to bear from opposite sides upon the planar sheet for producing their effect. The regions of these profiled tool halves assigned to the border edges 6 of the sheet 2 must herein enclose an appropriate converging shaping profile in between themselves according to FIGS. 7 or 8 with due regard to the respectively to be worked on sheet metal thickness. In this case the devices can also work with pairs of rollers or pressing or stamping die pairs, which act upon the sheet 2 in one work pass or in two subsequent work passes.

In conclusion it should be stated that the sheet metal heating packages 1 are assembled in such a way from sheets 2 of the groups 2*a* and 2*b*, that the border edges 6 of the sheets 2 having a minimum spacing 8 from each other are facing respectively the inlet- and outlet- sides of the heat exchanger media within the heat exchanger and consequently the material accumulations of the bead-like thickening of the coating 5 come to lie at points which are exposed to a particularly high corrosion.

The basic thought of the measures explained above is the creation of enameled metal sheets 2 for heaters with flattened edge zones, which can be combined into sheet metal heating packages 1 for heat exchangers. Herein the following measures are of particular importance:

All or a certain portion of the sheets 2 are profiled to be more shallow at the border edges 6 than the remaining area regions or are shaped so as to extend in a straight line or be smooth.

The straight or smooth border zones of the sheets 2 or those exhibiting the flatter profiling respectively face the inlet- and outlet-flow side in the sheet metal heating package 1.

The specially configured border edges 6 of the sheets 2 are formed in the course of the profiling process for instance by means of profiled rolls, for instance a pair of profiled rolls, by appropriate configuration of the shaping tool.

The profile height of the sheet 2 is formed or reformed by cone-shaped ends of the profiling tools so as to converge towards the border edges 6 of the sheets.

Shallow or straight and smooth border edges 6 of the sheets 2 can be fabricated by pairs of profiled rolls, which comprise smooth annularly-shaped segments at their end.

In sheets 2, for instance provided with continuous equally pronounced profiling by rolling a subsequent work process is performed which partially or entirely flattens the region of the border edges 6 of the sheets.

The border edges 6 of the sheets 2 already cut to dimension and to begin with provided with continuous and uniformly pronounced profiling are flattened by means of a press.

While the invention has been illustrated and described as embodied in a sheet metal for regenerative heat exchangers as well as a method and apparatus for manufacture of profiled metal sheets for such sheet metal packages, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claim.

1. A sheet metal heating package 1 for regenerative heat exchangers, comprising a plurality of superimposed metal sheets 2 and 2*a* or 2 and 2*b*, respectively, comprising a profiling 3 or a profile shape B having embossments as well as flow channels 4 between said sheets, every sheet of which is provided with a coating 5 serving as surface protection, characterized in that the profiling of the metal sheets 2 or 2*a*, 2*b* across a border strip comprises a profile height that is less than the height of the profiling 3 adjacent to the border edges 6 and along all border edges 6 of adjacent superimposed sheets 2 and 2*a* or 2 and 2*b* in the region of profiling 3 there is a minimum distance 8 between adjacent sheets.

2. A sheet metal heating package according to claim 1, wherein the minimum spacing between the border edges of the sheets is larger than a thickness of the coating of side faces of the border edges facing each other.

3. A sheet metal heating package according to claim 1, where the sheets have a profiling height that is reduced at least in a region of the border edges, as compared to the profiling height of remaining surface regions of the sheets.

4. A sheet metal heating package according to claim 1, wherein, respectively, only one of two adjoining directly superimposed sheets has a profiled border edge, while the border edge of the other sheet extends in a straight line.

5. A sheet metal heating package according to claim 1, wherein, respectively, only one border edge of two parallel border edges of a sheet is provided with a profiling, while the other border edge extends in a straight line, the respectively adjoining directly superimposed sheets being arranged so as to be turned through 180° in their plane relative to each other.

6. A sheet metal heating package according to claim 1, wherein the border edges of the sheets having a minimum spacing from each other respectively face an inflow-side and an outflow-side of the heat exchanger.

7. A sheet metal heating package according to claim 1, wherein the profiled sheets have embossments.

8. A sheet metal heating package according to claim 1, wherein the protective coating is an enamel layer.

* * * * *